US006148728A

United States Patent [19]

Shin et al.

[11] Patent Number: 6,148,728

[45] Date of Patent: Nov. 21, 2000

[54] METHOD FOR CLEANING A PRINTING PLATE AND APPARATUS FOR CLEANING THE PRINTING PLATE

[75] Inventors: Ki-chul Shin; Kyung-eun Lee, both of Seoul, Rep. of Korea

[73] Assignee: Samsung Electronics Co., Ltd., Suwon, Rep. of Korea

[21] Appl. No.: 09/288,035

[22] Filed: Apr. 8, 1999

[30] Foreign Application Priority Data

Jul. 14, 1998 [KR] Rep. of Korea ..... 98 28264

[51] Int. Cl.[7] ..... B41C 35/00

[52] U.S. Cl. ..... 101/483; 101/424

[58] Field of Search ..... 101/483, 424, 101/423, 425; 134/18

[56] References Cited

U.S. PATENT DOCUMENTS

| | | | |
|---|---|---|---|
| 3,635,711 | 1/1972 | Miller et al. | 96/35.1 |
| 3,661,660 | 5/1972 | Wessells et al. | 156/14 |
| 4,555,302 | 11/1985 | Urbanik | 156/637 |
| 5,088,510 | 2/1992 | Bannon | 134/105 |
| 5,322,078 | 6/1994 | Tuttle | 134/104.4 |
| 5,382,298 | 1/1995 | Bondurant | 101/424 |
| 5,533,446 | 7/1996 | Hashimura et al. | 101/150 |
| 5,636,571 | 6/1997 | Abrahamson | 101/425 |
| 5,755,883 | 5/1998 | Kinose et al. | 118/110 |
| 5,778,792 | 7/1998 | Lu | 101/483 |

*Primary Examiner*—John S. Hilten
*Assistant Examiner*—Anthony H. Nguyen
*Attorney, Agent, or Firm*—Howrey Simon Arnold & White, LLP

[57] ABSTRACT

A method and an apparatus for cleaning a printing plate for fabricating an alignment film in which the printing plate is dipped into an internal container filled with a solvent and a predetermined vibration is transmitted to the printing plate so as to remove a polyimide remaining at the printing plate. In addition, the printing plate is loaded into a heater tank and baked at a high temperature with an injected gas, to thereby completely remove solvent residuals at the printing plate, completely cleaning the printing plate and preventing solvent residuals from solidifying.

11 Claims, 3 Drawing Sheets

METHOD FOR CLEANING A PRINTING PLATE AND APPARATUS FOR CLEANING THE PRINTING PLATE

BACKGROUND OF THE INVENTION

1. Field of the Invention

The present invention relates to a printing plate for fabricating an alignment film for use in a liquid crystal display (LCD), and more particularly to a method for cleaning a printing plate for fabricating an alignment film that can prevent in advance residuals from solidifying, and an apparatus for cleaning the printing plate applied for such a method.

2. Description of the Related Art

Recently, LCD devices are widely used for flat panel displays. Especially, the smaller, lighter and less power consumptive characteristics make the LCD devices considered as one of the most leading display devices for replacing a cathode ray tube (CRT).

Generally, an LCD device is structured to have two glass substrates with the liquid crystal material injected therebetween. Liquid crystal molecules are arranged in a specific direction and scattered dynamically according to an electrical signal so that the amount of light transmission of the device can be properly controlled. Here, the molecules of the liquid crystal display are required to be arranged in a specific direction to assist the optical function of the LCD. Generally, molecules of the liquid crystal material align themselves locally. Thus, in a conventional manufacturing process, an organic high polymer film directly contacting the molecules of the liquid crystal material is formed on an indium tin oxide (ITO) electrode in order to align the molecules of the liquid crystal material in a specific direction. Here, the organic high polymer film is generally called an alignment film.

Recently, the alignment film is mainly made up of a polyimide resin formed of a polyamide acid and a polyimide. This is because the polyamide acid and polyimide have a high degree of heat resistance and stability, and are easy to deposit and are good at controlling an alignment.

Meanwhile, in forming an alignment film, various methods, such as a spray method, a dip method and a printing method, can be used. Recently, the printing method, for example, a flexo printing method, is widely used for mass productions.

In the flexo printing method, liquid material for an alignment film such as polyimide solution is supplied by a dispenser and passes between a doctor roll and an anilox roll, moving to a printing plate rolled onto a printing roll. Here, a plurality of projections are formed on the surface of the printing plate, and intaglios are defined between projections so as to accommodate the supplied liquid.

Then, the printing plate accommodating the liquid at each projection and intaglio rotates as the printing roll rotates. As rotating, the printing plate contacts a glass substrate moving beneath the printing plate, and forms a thin alignment film on the surface of the glass substrate.

Such a method for forming an alignment film is disclosed in the U.S. Pat. No. 5,533,446 entitled "Thin film forming apparatus and thin film forming method" and the U.S. Pat. No. 5,755,883 entitled "Roll coating device for forming a thin film of uniform thickness".

When the alignment film is all deposited onto the glass substrate, the printing plate is wiped out for another use.

First, the surfaces of the projections and intaglios of the printing plate are wiped out with a soft cloth dipped in solvent. Thus, the polyimide remaining on the surfaces of the projections and intaglios is dissolved by the solvent and wiped out.

Subsequently, the surfaces of the projections and intaglios are wiped out again with a cloth dipped in a volatile solution such as acetone or methyl alcohol. Thus, the solvent remaining on the surfaces of the projections and intaglios are evaporated and removed.

After such a cleaning process, the remaining polyimide or solvents are finally removed by another cleaning solution.

The cleaned printing plate is kept for a certain period in a dark room, and used again when needed.

However, the conventional cleaning method has some serious problems.

The used printing plate manually cleaned by the operator is used again in the next printing process. If the polyimide remaining after the first cleaning step contacts the volatile solution in the second cleaning step, the polyimide remaining at the surfaces of the projections and intaglios chemically reacts to the volatile solution, forming solid residuals.

The solid residuals degrade a uniformity of the alignment film deposited onto the glass substrate.

Moreover, the solid residuals fallen onto the glass substrate may create a plurality of pinholes on the surface of the glass substrate when pressed by the rotating printing roll.

The pinholes obstruct smooth display of the image and significantly degrades an overall printing quality.

Manual removal of the polyimide remaining on the surfaces of the projections and intaglios is also dangerous, since the solvent for removing the polyimide is known as extremely harmful to the human body.

In addition, the manual removal performed whenever a certain printing process is finished degrades the operator's efficiency significantly.

SUMMARY OF THE INVENTION

It is therefore an object of the present invention to remove residual polyimide and solvent without forming a solid by preventing in advance the solvent from contacting the polyimide.

It is another object of the present invention to enhance a uniformity of the final alignment film deposited onto a glass substrate.

It is a further object of the present invention to deter the formation of a pinhole by preventing a solid from falling onto a glass substrate.

It is a still further object of the present invention to improve an overall printing quality by preventing the formation of pinholes.

It is yet another object of the present invention to protect an operator from contacting harmful substances by eliminating manual operation in removing the polyimide.

It is still a further object of the present invention to improve the efficiency of the operator by cleaning a printing plate without manual operations.

To achieve the above objects and other advantages, a method and an apparatus for cleaning a printing plate for fabricating an alignment film are provided. The printing plate to be cleaned is dismounted from a printing roll and loaded onto the cleaning apparatus having internal and external containers after a deposition of an alignment film is completed. The internal container is filled with the solvent composed of γ-buthylrolactone or N-Methyl-Pyrrolidone (NMP) and the printing plate loaded onto the cleaning apparatus is dipped in the internal container.

Here, an ultrasonic vibrating plate mounted onto a side wall of the internal container vibrates with the solvent, removing all the polyimide remaining at the printing plate.

The printing plate is loaded into a heater tank to remove the remaining solvent thereon. The heater tank bakes the printing plate at a temperature of 80° C. to 100° C., to thereby evaporate all the solvent remaining on the printing plate. At this time, inert gas, for example, nitrogen ($N_2$) gas, flows into the heater tank to expedite the evaporation of the solvent. When such processes are finished, the residual polyimide is all removed, and the printing plate can be re-used in another printing process when necessary.

BRIEF DESCRIPTION OF THE DRAWINGS

The above object and other advantages of the present invention will become more apparent by describing in detail the preferred embodiments thereof with reference to the accompanying drawings, in which.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein.

Figure 1:
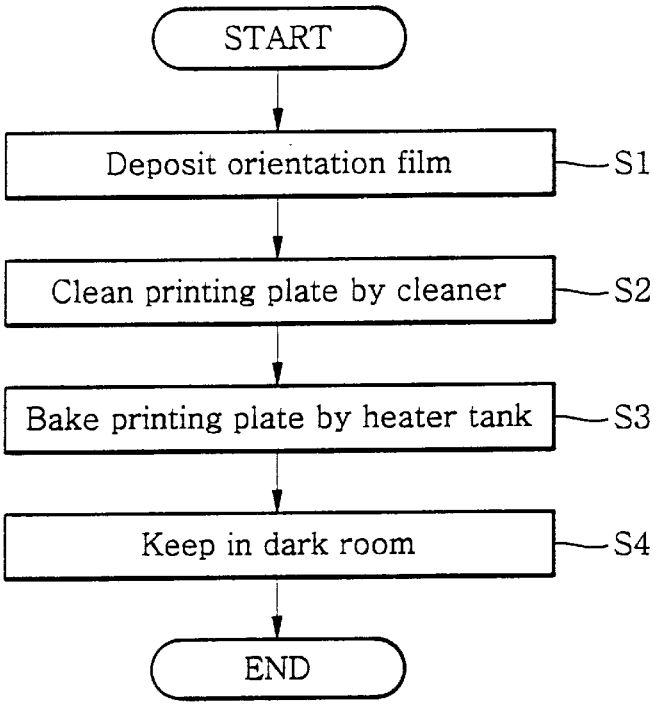
FIG. 1 is a flow diagram showing a method of cleaning a printing plate for fabricating an alignment film according to the present invention.

Referring to FIG. 1, an alignment film is deposited at step S1.

Figure 2:
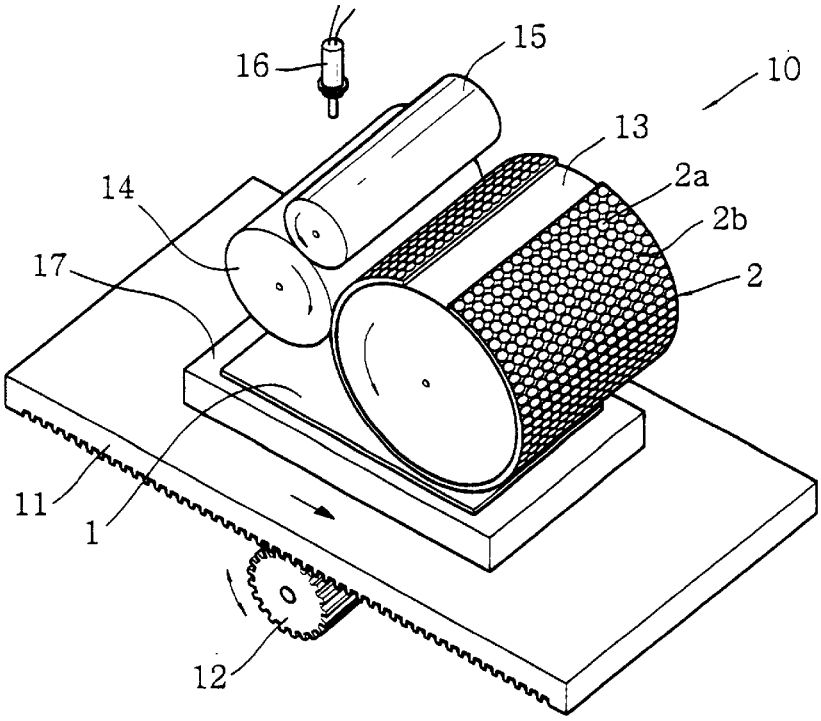
FIG. 2 is a perspective view showing a printing apparatus according to the present invention.
Figure 3:
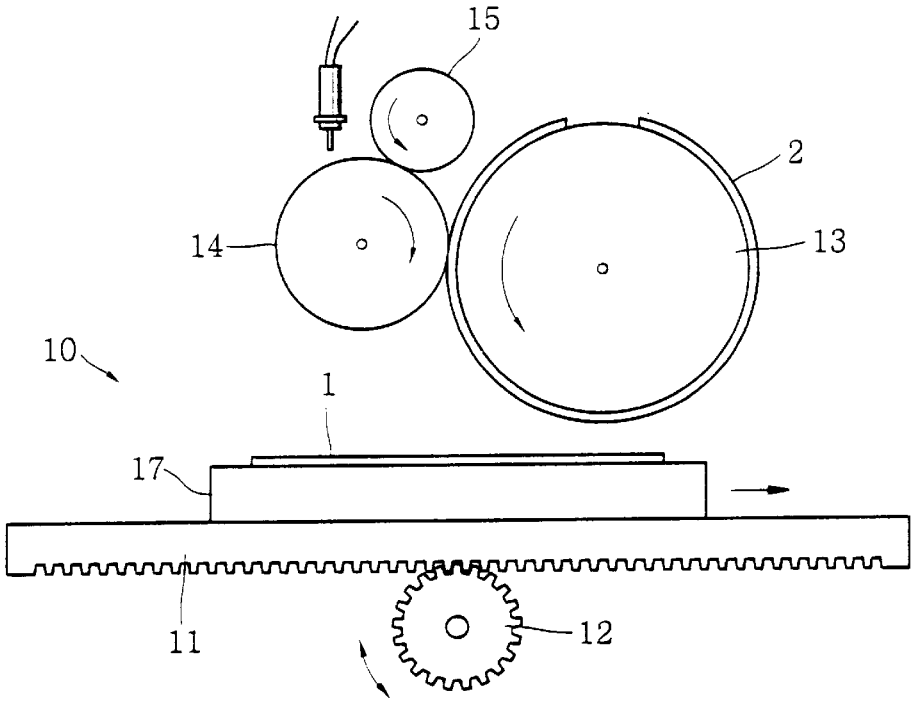
FIG. 3 is a sectional view of the printing apparatus shown in FIG. 2.

Here, as shown in FIGS. 2 and 3, polyimide solution provided by a dispenser 16 of a printing apparatus 10 is flowed between a rubber doctor roll 15 and a ceramic anilox roll 14, is dropped down by a rotation of the anilox roll 14, and is adhered onto a printing plate 2 rolled over the circumferential surface of a printing roll 13.

Here, a plurality of projections 2*a* are formed on the surface of the printing plate 2, and intaglios 2*b* are defined between projections 2*a* so as to accommodate the polyimide solution.

As the printing roll 13 rotates, a power is supplied to a motor (not shown) and a pinion gear 12 rotates. Thus, driving power of the motor is transmitted to a rack gear 11, which moves forward at a predetermined speed a table 17 on which the glass substrate 1 is mounted. Here, the rotation speed of the printing roll 13 and the forward speed of the table 17 are set to be the same.

Then, the printing plate 2 where the polyimide solution is adhered onto the surfaces of projections 2*a* and into intaglios 2*b* rotates in accordance with the rotation of the printing roll 13, and thus contact the glass substrate 1 moving beneath the printing plate 2. Thus, a thin alignment film is formed on the surface of the glass substrate 1.

When the alignment film is all deposited on the glass substrate 1, an operator cleans the printing plate 2 for reuse, at step S2. Here, a plurality of printing apparatuses are provided in the production line. Therefore, the operator gathers all printing plates from the printing apparatuses that finished printing processes and wipes them out altogether.

First, the operator dismounts the printing plates 2 that finished the deposition of the alignment film from the printing roll 13, and dips them into the solvent to remove the polyimide solution remaining at the surfaces of projections 2*a* and intaglios 2*b*.

Figure 4:
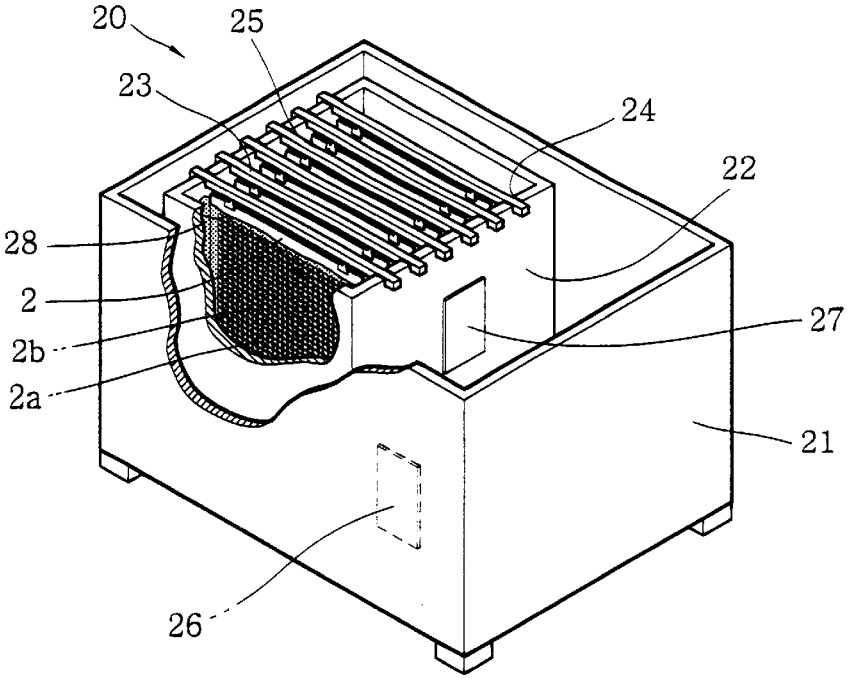
FIG. 4 is a perspective view showing an apparatus for cleaning the printing plate according to the present invention.

The process of removing the polyimide solution is performed by a cleaning apparatus in accordance with another aspect of the present invention shown in FIG. 4.

As shown in FIG. 4, a cleaner 20 includes an external container 21, and an internal container 22 with a predetermined amount of solvent 28 mounted into the external container 21.

The external container 21 protects the internal container 22 from an external impact and prevents the solvent 28 from flowing out.

Here, the printing plate 2, supported by a plurality of supporting bars 23 bridged between the two opposing walls of the internal container 22, is dipped into the solvent 28 filled in the internal container 22.

Preferably, a plurality of grooves 24 for fixing the supporting bars 23 are formed on the top surfaces of the opposing walls of the internal container 22. The supporting bars 23 can be firmly fixed onto the internal container 22 by grooves 24.

Preferably, a plurality of pairs of clamp-shaped holding tools 25 for holding the printing plate 2 dipped into the solvent 28 are arranged facing toward the lower portion of the internal container 22, at the supporting bars 23. Thus, the printing plate 2 can be firmly fixed to the supporting bars 23 and is dipped into the solvent 28. A plurality of printing plates can be fixed in this manner and are hung in the upper portion of the internal container 22.

A plurality of, preferably two, vibrating plates 27 controlled by a cleaner controller 26 are arranged onto the outer surfaces of the side walls of the internal container 22. The vibrating plates 27 serve to transmit a predetermined vibration to the solvent 28 through the side walls of the internal container 22.

Waste pipes (not shown) are formed on the side walls of the internal container 22 so as to let out the solvent 28 contaminated.

In the cleaner 20 of the present invention, when the printing plates 2 are gathered for cleaning, they are hung by supporting bars 23 and dipped into the solvent 28. The cleaner controller 26 transmits a signal to vibrating plates 27 to generate predetermined vibrations, preferably, ultrasonic vibrations.

At this time, vibrating plates 27 vibrate by the signal transmitted from the cleaner controller 26, and transmit a wave motion of a predetermined size to the solvent 28 filled in the internal container 22.

In such a case, a pressure becomes temporarily or locally increased in the solvent 28 due to the transmitted wave motion, which breaks the solvent 28 into extremely minute fragments, causing a cavitation in the solvent 28.

The cavitation is rapidly transmitted to the printing plate 2 dipped into the solvent 28.

Fragments of the solvent 28 continually collide with projections 2*a* and intaglios 2*b*, thus cleaning the surfaces and inner surfaces of projections 2*a* and intaglios 2*b*. As a result, the polyimide remaining at the surfaces and inner surfaces thereof can be completely removed.

Here, the solvent 28 is γ-buthylrolactone or N-Methyl-Pyrrolidone (NMP) known to have an excellent solubility to polyimide.

When the printing plates 2 are dipped into the γ-buthylrolactone or N-Methyl-Pyrrolidone (NMP) and vibrated for a few minutes, they can be further completely cleaned by a complementary operation of the solvent 28 and vibrating plates 27.

In the cleaning process of the present invention, such solutions as acetone, methyl alcohol, or ethyl alcohol, which react to the polyimide and thus generate a solid, are not used.

If the polyimide remaining after the use of the solvent contacts such a cleaning solution as acetone, a polyimide component is solidified in the intaglios by an interaction between the polyimide and the cleaning solution.

However, in the present invention, such a cleaning solution as acetone is not used and only the solvent 28 is used to remove the polyimide remaining at the printing plate 2. Thus, it can prevent in advance the polyimide from solidifying.

Accordingly, if the printing plate 2 is re-used in the further printing process, it can form a final alignment film with a uniform thickness. Further, pinholes can be eliminated on the glass substrate 1 on which the alignment film is formed.

In cleaning the printing plate 2 using the solvent 28, the vibration generated by an ultrasonic wave actively expedites cleaning effect of the solvent 28. Therefore, even a small amount of polyimide remaining between projections 2*a* or intaglios 2*b* of the printing plate 2 can be completely removed.

Furthermore, the process of removing the polyimide is automatically performed by the cleaner 20, eliminating operator's manual work. As a result, the operator can be protected from contacting harmful substances while enhancing the efficiency of the operator.

Preferably, the process of removing the polyimide is performed for a time period of 5 to 10 minutes.

When the solvent 28 that fills the internal container 22 is contaminated by a repeated process of removing the polyimide, the operator let out the solvent through the waste pipes. Then, he/she refills the internal container 22 with a new solvent so as to maintain the cleaning process at a predetermined level of cleanness.

When the cleaning process using the solvent 28 is all finished, the operator bakes the printing plate 2 to dry the solvent 28 remaining on the printing plate 2, at step S3.

Figure 5:
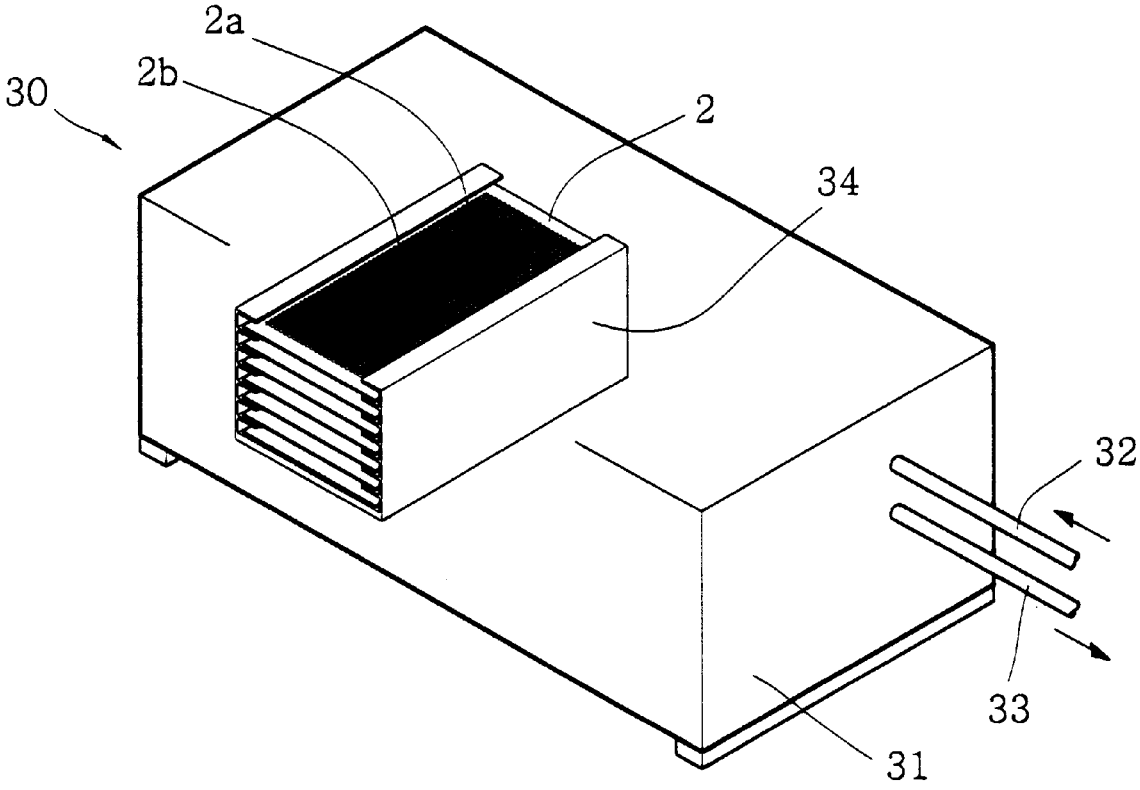
FIG. 5 is a perspective view showing a heater tank according to the present invention.

In more detail, when the cleaning process is finished, the operator moves the printing plate 2 into a main body 31 of a heater tank 30 shown in FIG. 5. At this time, a plurality of printing plates are loaded into a frame 34 without contacting each other. This is to put printing plates 2 such that each surface thereof can be widely exposed in the inner space of the heater tank 30 for maximizing the evaporation of the solvent 28 in the subsequent baking process.

When printing plates 2 are all loaded into the heater tank 30 and a power is on, the heater tank 30 is heated at a high temperature, 80° C. to 100° C. Here, the solvent 28 remaining at the surface of the printing plate all evaporates at the high temperature.

Here, inert gas, for example, nitrogen ($N_2$) gas, flows into the heater tank through a gas injecting pipe 32.

The nitrogen ($N_2$) gas is diffused to the inner space of the heater tank 30 and contacts the surface of each printing plate 2, expediting the evaporation of the solvent 28.

Chemically inert nitrogen ($N_2$) gas does not react with the printing plate 2, leaving it undamaged.

The solvent 28 is generally known as being evaporated at a temperature of 190° C. to 200° C. However, in the present invention, the nitrogen ($N_2$) gas is injected so as to expedite the evaporation of the solvent 28. Thus, the solvent 28 remaining at printing plates 2 can be completely removed even at a temperature of 80° C. to 100° C.

When the nitrogen ($N_2$) gas is injected for minutes at the temperature of 80° C. to 100° C., the solvent 28 remaining at the printing plate 2 can be further completely removed by the complementary operation of the high temperature and the gas injection.

Preferably, the baking process is performed for a time period of 10 to 30 minutes. After baking, the injected nitrogen ($N_2$) gas is discharged via a gas outlet 33.

When the processes are all completed, the solvent 28 remaining at the printing plate 2 is all removed. Thus the printing plate 2 can be rapidly restored to the initial clean state.

When the cleaning and baking processes are all completed, the printing plate 2 is kept at a dark room for a predetermined time period, at step S4. When the printing plate 2 is required to be re-used, the printing plate 2 is carried out from the dark room and used again for the printing process.

Preferably, the outer wall of the heater tank 30 may be wrapped by cellophane paper to prevent light from entering the chamber.

If the heater tank 30 is wrapped with cellophane paper to cut off light, the cleaned and baked printing plates 2 can be stored in the heater tank after baking and can be used for the later printing process. This could eliminate an additional dark room in the production line, improving the efficiency of the whole manufacturing process.

In the present invention, the printing plate is cleaned automatically without contacting the solvent with the cleaning solution, which prevents in advance the residuals from solidifying.

In the present invention, the printing plate is dipped into the internal container filled with the solvent, and a certain vibration is transmitted to the printing plate to remove the polyimide remaining at the printing plate.

In addition, the printing plate is loaded to a heater tank and the surface thereof is baked at a high temperature with nitrogen gas, thereby completely removing the solvent remaining at the printing plate.

Thus, an excellent effect of cleaning the printing plate can be achieved, without solidified residuals.

The present invention is not restricted to a method for cleaning a printing plate for fabricating an alignment film, and can be applied to various facilities where the impurities are needed to be removed, such as semiconductor fabrication facilities.

This invention has been described above with reference to the aforementioned embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A method for cleaning a printing plate, comprising the steps of:

dismounting the printing plate from a printing roll;

dipping the printing plate into a solvent and transmitting a vibration to the solvent to remove liquid material remaining on the printing plate;

loading the printing plate to a heater tank; and baking the plate at a predetermined temperature to remove the solvent.

2. The method according to claim 1, wherein the printing plate is for fabricating an alignment film.

3. The method according to claim 2, wherein the solvent is comprised of one of y-buthylrolactone and N-Methyl-Pyrrolidone (NMP).

4. The method according to claim 2, wherein the vibration is generated by an ultrasonic wave.

5. The method according to claim 2, wherein the step of dipping is performed for the time period of 5 to 10 minutes.

6. The method according to claim 2, wherein inert gas is injected into the heater tank during the step of baking.

7. The method according to claim 6, wherein the inert gas is nitrogen ($N_2$) gas.

8. The method according to claim 2, wherein the step of baking is performed at a temperature of 80° C. to 100° C.

9. The method according to claim 8, wherein the step of baking is performed for a time period of 10 to 30 minutes.

10. The method according to claim 2, wherein the heater tank is cut off from light.

11. The method according to claim 10, wherein the heater tank is cut off from light by cellophane paper.

* * * * *